US010544666B1

(12) United States Patent
Williams

(10) Patent No.: US 10,544,666 B1
(45) Date of Patent: Jan. 28, 2020

(54) FORMATION DIP GEO-STEERING METHOD

(71) Applicant: Danny T. Williams, Houston, TX (US)

(72) Inventor: Danny T. Williams, Houston, TX (US)

( * ) Notice: Subject to any disclaimer, the term of this patent is extended or adjusted under 35 U.S.C. 154(b) by 0 days.

(21) Appl. No.: 16/437,717

(22) Filed: Jun. 11, 2019

Related U.S. Application Data

(63) Continuation-in-part of application No. 16/181,155, filed on Nov. 5, 2018, now Pat. No. 10,316,638, which is a continuation-in-part of application No. 15/461,213, filed on Mar. 16, 2017, now Pat. No. 10,119,385, which is a continuation-in-part of application No. PCT/US2015/050496, filed on Sep. 16, 2015, which is a continuation of application No. 14/488,079, filed on Sep. 16, 2014, now Pat. No. 8,960,326, which is a continuation-in-part of application No. 13/660,298, filed on Oct. 25, 2012, now Pat. No. 8,875,806, which is a continuation-in-part of application No. 13/568,269, filed on Aug. 7, 2012, now abandoned, which is a continuation of application No. 13/347,677, filed on Jan. 10, 2012, now abandoned, which is a continuation of application No. 13/154,508, filed on Jun. 7, 2011, now abandoned, which is a continuation of application No. 12/908,966, filed on Oct. 21, 2010, now abandoned, which is a continuation of application No. 12/431,339, filed on Apr. 28, 2009, (Continued)

(51) Int. Cl.

| | |
|---|---|
| ***E21B 44/00*** | (2006.01) |
| ***E21B 49/00*** | (2006.01) |
| ***E21B 4/02*** | (2006.01) |
| ***E21B 47/026*** | (2006.01) |
| ***E21B 7/04*** | (2006.01) |
| ***E21B 47/06*** | (2012.01) |
| ***E21B 47/12*** | (2012.01) |
| ***E21B 45/00*** | (2006.01) |

(52) U.S. Cl.

CPC ..... *E21B 44/005* (2013.01); *E21B 4/02* (2013.01); *E21B 7/04* (2013.01); *E21B 45/00* (2013.01); *E21B 47/026* (2013.01); *E21B 47/06* (2013.01); *E21B 47/12* (2013.01); *E21B 49/003* (2013.01)

(58) Field of Classification Search

None

See application file for complete search history.

(56) References Cited

U.S. PATENT DOCUMENTS

| | | | |
|---|---|---|---|
| 514,170 | A | 2/1894 | Tesla |
| 2,176,169 | A | 10/1939 | Georges |

(Continued)

FOREIGN PATENT DOCUMENTS

| | | | |
|---|---|---|---|
| EP | 0015137 | A1 | 9/1980 |
| WO | 2011146079 | A1 | 11/2011 |
| WO | 2014077799 | A1 | 5/2014 |

*Primary Examiner* — Paul B Yanchus, III

(74) *Attorney, Agent, or Firm* — Rao DeBoer Osterrieder, PLLC; Dileep P. Rao

(57) ABSTRACT

A method of drilling a well within a target stratum. The method can include drilling based upon a target window created from previously collected and/or extrapolated data. Data is collected while drilling and the target window can be adjusted "on the fly" as well as updating and correcting previously collected data. The method can be repeated to ensure optimal drilling efficiency and minimal down time while drilling.

12 Claims, 2 Drawing Sheets

Related U.S. Application Data now abandoned, which is a continuation of application No. 11/705,990, filed on Feb. 14, 2007, now Pat. No. 7,546,209, which is a continuation of application No. 10/975,966, filed on Oct. 28, 2004, now Pat. No. 7,191,850.

(56) References Cited

U.S. PATENT DOCUMENTS

| | | | |
|---|---|---|---|
| 2,586,939 | A | 2/1952 | Grable |
| 2,658,284 | A | 11/1953 | Jacobs |
| 3,437,169 | A | 4/1969 | Youmans |
| 3,823,787 | A | 7/1974 | Haworth et al. |
| 4,386,664 | A | 6/1983 | Miller |
| 4,804,051 | A | 2/1989 | Ho |
| 5,237,539 | A | 8/1993 | Selman |
| 5,311,951 | A | 5/1994 | Kyte et al. |
| 5,678,643 | A | 10/1997 | Robbins et al. |
| 5,812,068 | A | 9/1998 | Wisler et al. |
| 5,821,414 | A | 10/1998 | Noy et al. |
| 6,272,434 | B1 | 8/2001 | Wisler et al. |
| 6,556,016 | B2 | 4/2003 | Gao et al. |
| 6,631,563 | B2 | 10/2003 | Brosnahan et al. |
| 6,643,589 | B2 | 11/2003 | Zhang et al. |
| 6,760,665 | B1 | 7/2004 | Francis |
| 6,819,111 | B2 | 11/2004 | Fanini et al. |
| 6,877,241 | B2 | 4/2005 | Barr et al. |
| 6,885,947 | B2 | 4/2005 | Xiao et al. |
| 7,188,685 | B2 | 3/2007 | Downton et al. |
| 7,191,850 | B2 | 3/2007 | Williams |
| 7,546,209 | B2 | 6/2009 | Williams |
| 7,689,969 | B1 | 3/2010 | Wendling |
| 8,042,616 | B2 | 10/2011 | Giroux et al. |
| 8,061,442 | B2 | 11/2011 | Alberty |
| 8,463,549 | B1 | 6/2013 | Selman et al. |
| 8,463,550 | B1 | 6/2013 | Selman et al. |
| 8,875,806 | B2 | 11/2014 | Williams |
| 8,960,326 | B2 | 2/2015 | Williams |
| 9,534,446 | B2 | 1/2017 | Williams |
| 10,119,385 | B2 | 11/2018 | Williams |
| 10,316,638 | B1 | 6/2019 | Williams |
| 2003/0037963 | A1 | 2/2003 | Barr et al. |
| 2003/0056381 | A1 | 3/2003 | Brosnahan et al. |
| 2003/0121702 | A1 | 7/2003 | Downton et al. |
| 2003/0127252 | A1 | 7/2003 | Downton et al. |
| 2006/0090934 | A1 | 5/2006 | Williams |
| 2007/0205020 | A1 | 9/2007 | Williams |
| 2009/0132458 | A1 | 5/2009 | Edwards et al. |
| 2009/0260881 | A1 | 10/2009 | Williams |
| 2010/0185395 | A1* | 7/2010 | Pirovolou ..... E21B 44/00 702/9 |
| 2011/0031019 | A1 | 2/2011 | Williams |
| 2011/0232967 | A1 | 9/2011 | Williams |
| 2012/0046868 | A1 | 2/2012 | Tchakarov et al. |
| 2013/0140088 | A1 | 6/2013 | Williams |
| 2014/0131102 | A1 | 5/2014 | Benson et al. |
| 2014/0360781 | A1 | 12/2014 | Williams |
| 2015/0000980 | A1 | 1/2015 | Williams |

* cited by examiner

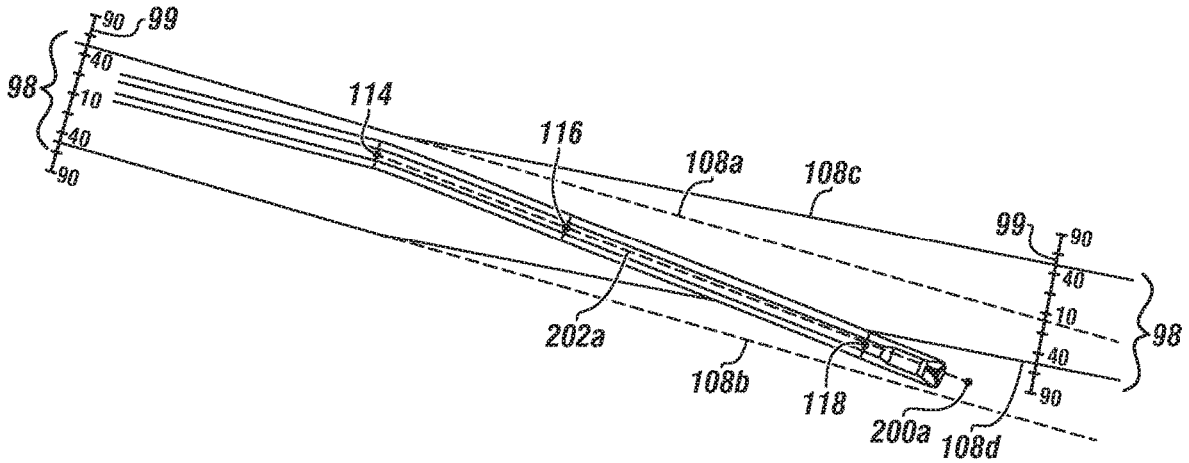
FIGURE 2
FIGURE 3
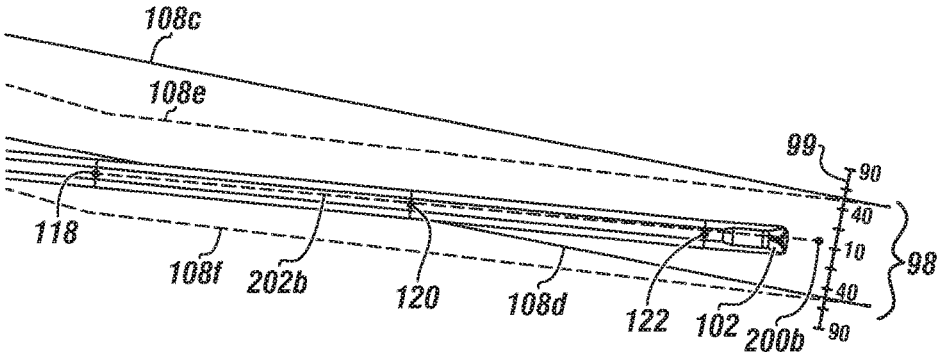

FORMATION DIP GEO-STEERING METHOD

CROSS REFERENCE TO RELATED APPLICATIONS

The present application is a Continuation in Part and claims priority to and the benefit of U.S. patent application Ser. No. 16/181,155 filed on Nov. 5, 2018, which issued as U.S. Pat. No. 10,316,638 on Jun. 11, 2019, which is a continuation in part of U.S. patent application Ser. No. 15/461,213 filed on Mar. 16, 2017, which issued as U.S. Pat. No. 10,119,385 on Nov. 6, 2018, which is a Continuation in Part and claims priority to International Patent Application No. PCT/US2015/050496 filed on Sep. 16, 2015, which claims priority to U.S. patent application Ser. No. 14/488,079 filed on Sep. 16, 2014, which issued as U.S. Pat. No. 8,960,326 on Feb. 24, 2015, which is a continuation in part of U.S. patent application Ser. No. 13/660,298 filed on Oct. 25, 2012, which issued as U.S. Pat. No. 8,875,806 on Nov. 4, 2014, which is a continuation in part of U.S. patent application Ser. No. 13/568,269 filed on Aug. 7, 2012, which is a continuation of U.S. patent application Ser. No. 13/347,677, filed on Jan. 10, 2012, which is a continuation of U.S. patent application Ser. No. 13/154,508, filed on Jun. 7, 2011, which is a continuation of U.S. patent application Ser. No. 12/908,966, filed on Oct. 21, 2010, which is a continuation of U.S. patent application Ser. No. 12/431,339, filed on Apr. 28, 2009, which is a continuation of U.S. patent application Ser. No. 11/705,990, filed on Feb. 14, 2007, which issued as U.S. Pat. No. 7,546,209 on Jun. 9, 2009, which is a continuation of U.S. patent application Ser. No. 10/975,966, filed on Oct. 28, 2004, which issued as U.S. Pat. No. 7,191,850 on Mar. 20, 2007, all of which are entitled "FORMATION DIP GEO-STEERING METHOD." These references are hereby incorporated in their entirety.

FIELD

The present embodiments relate to methods of steering and guiding a drill bit's trajectory, and more specifically, but not by way of limitation, to methods of geo-steering and guiding a bit's trajectory while drilling directional and horizontal wells.

BACKGROUND

In the exploration, drilling, and production of hydrocarbons, it becomes necessary to drill directional and horizontal wells. As those of ordinary skill in the art appreciate, directional and horizontal wells can increase the production rates of reservoirs. Hence, the industry has seen a significant increase in the number of directional and horizontal wells drilled. Additionally, as the search for hydrocarbons continues, operators have increasingly been targeting thin beds and/or seams with high to very low permeability. The industry has also been targeting conventional and unconventional hydrocarbon reservoirs such as tight sands, shales, carbonates, lime stone, chert, salt domes, ash, anhydrate, and coal.

Traditionally, these thin bed reservoirs, coal seams, shales and sands may range from less than five feet to greater than twenty feet. In the drilling of these thin zones, operators attempt to steer the drill bit within these zones. As those of ordinary skill in the art will recognize, keeping the wellbore within the zone is highly desirable for several reasons including, but not limited to, maintaining greater drilling rates to reduce the number of drilling days, maximizing production rates once completed, limiting water production, preventing wellbore stability problems, exposing more productive zones, keeping the wellbore clean, reducing torque and drag, smoother production casing runs, etc.

Various prior art techniques have been introduced. However, all these techniques suffer from several problems. For instance, in the oil and gas industry, it has always been an accepted technique to gather surface and subsurface information and then map or plot the information to give a better understanding of what is actually happening below the earth's surface. Some of the most common mapping techniques used today includes elevation contour maps, formation contour maps, sub-sea contour maps, seismic maps, synthetic maps, and formation thickness (isopac) maps.

Some or most of these can be presented together on one map or separate maps. For the most part, the information that is gathered to produce these maps are from electric logging and real time measurement while drilling and logging devices (gamma ray, resistivity, density neutron, sonic or acoustic, surface and subsurface seismic, or any available electric log). This type of data is generally gathered during, or after a well is drilled. Additionally, measurement while drilling and logging while drilling techniques allow the driller, real time access while drilling to subterranean data such as gamma ray, resistivity, density neutron, and sonic or acoustic and subsurface seismic. This type of data is generally gathered during the drilling of a well.

These logging techniques have been available and used by the industry for many years. However, there is a need for a technique that will utilize previously collected historical well data and real time surface and downhole data to steer the bit through a zone of interest. There is a need for a method that will produce, in real time during drilling, an instantaneous dip for a very thin target zone. There is also a need for a process that will utilize the instantaneous dip, at user specified intervals, to produce a calculated target window (top and bottom) and extrapolate this window ahead of the projected well path so an operator (i.e. anyone controlling drill bit position or steering) can keep the drill bit within the target zone identified by the calculated dip and associated calculated target window. There is a further need for a process that can identify and modify a target zone without the need to stop drilling.

In the normal course of drilling, at user specified intervals, surveys are periodically performed. As those of ordinary skill in the art will appreciate, in order to guide a wellbore to a desired target, the position and direction of the wellbore at any particular depth must be known. Since the early days of drilling, various tools have been developed to measure the inclination, azimuth, and vertical depth of the wellbore.

In order to calculate the three-dimensional path of the wellbore, it is necessary to take measurements, at user specified intervals, along the wellbore at known depths of the inclination angle (angle from vertical) and azimuth angle (direction normally relative to true north). These measurements are called surveys and are typically conducted when drilling has temporarily ceased but can also be produced while drilling the well.

Prior art survey tools include those such as but not limited to: steering tools, tools associated with measurement while drilling (MWD), electro-magnetic measurement while drilling (EM-MWD), gyro survey tools, and magnetic single shot (MSS). One such method, after drilling a hole section of a well, a wireline survey is run inside the drill pipe before pulling out with the drill bit, or by running a wireline survey inside the steel casing once it is cemented in place. During drilling, many government regulations require the running of a wireline survey or getting an MWD survey, or EM-MWD survey, in some cases every 200 feet for horizontal or deviated wells and every 500 feet for vertical wells.

In today's environment of drilling and steering in ultra-thin target zones, knowing the true stratigraphic position and direction of the bit within the true stratigraphic formation is critical. Operators need to know the accurate position of the bit and bit projection path. In the event of an actual deviation from a planned stratigraphic wellbore projection path, time is critical in order to correct the bit direction back to the planned true stratigraphic path to prevent the bit from drilling into nonproductive zones.

BRIEF DESCRIPTION OF THE DRAWINGS

The detailed description will be better understood in conjunction with the accompanying drawings as follows:

FIG. 2 is a schematic representation of a wellbore showing a change in stratum dip according to one or more embodiments.

FIG. 3 is a schematic representation of a wellbore showing a correction in steering the drillbit according to one or more embodiments.

Figure 1:
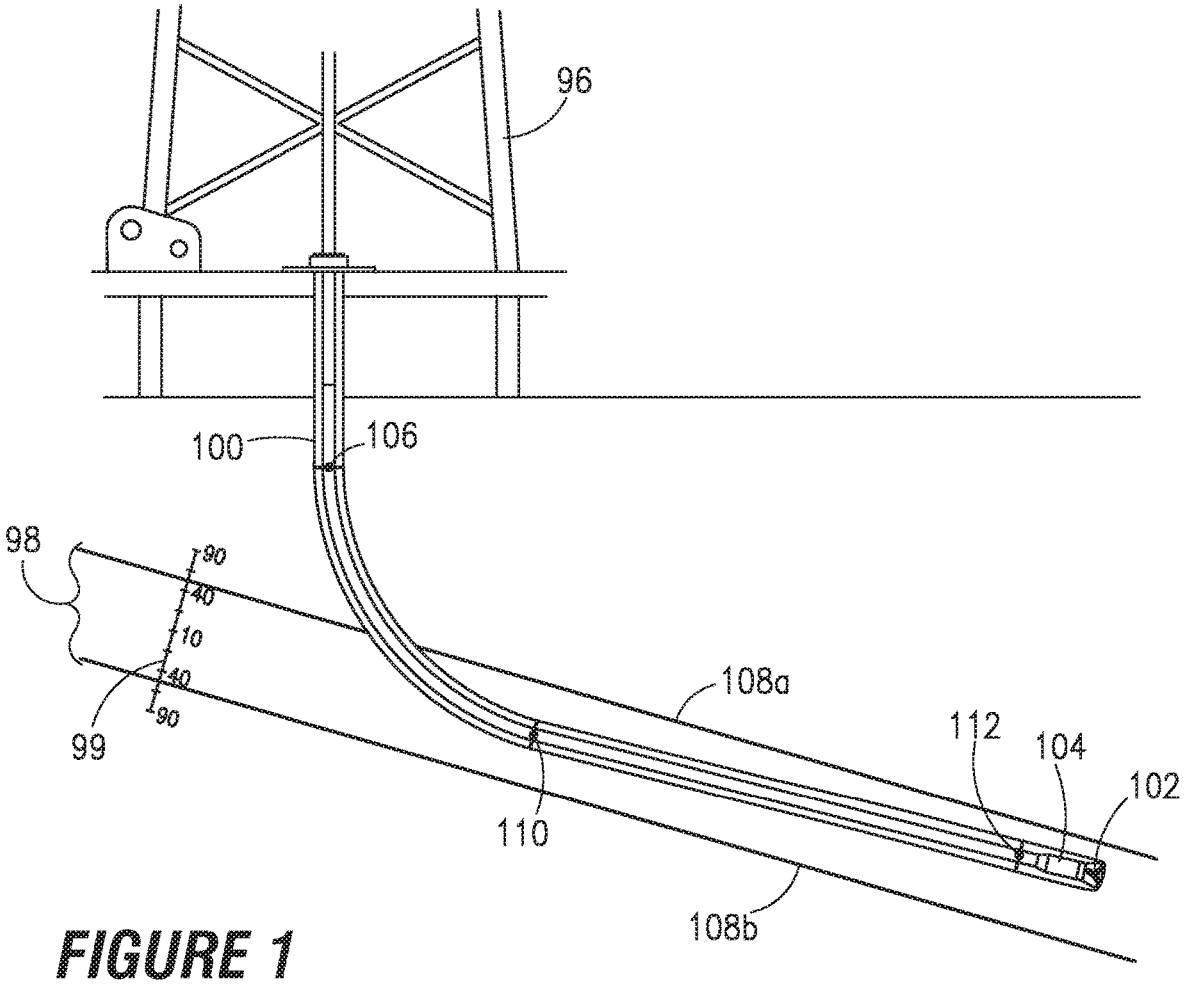
FIG. 1 is a schematic representation of a wellbore according to one or more embodiments.

The present embodiments are detailed below with reference to the listed Figures.

DETAILED DESCRIPTION OF THE EMBODIMENTS

Before explaining the present disclosure in detail, it is to be understood that the disclosure is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only and are not intended to be limiting.

Specific structural and functional details disclosed herein are not to be interpreted as limiting, but merely as a basis of the claims and as a representative basis for teaching persons having ordinary skill in the art to variously employ the present embodiments. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The word "about" means plus or minus 5% of the stated number.

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

When methods are disclosed or discussed, the order of the steps is not intended to be limiting, but merely exemplary unless otherwise stated. Even methods disclosed in outline form do not dictate the order of the steps but are merely organized in that manner for clarity.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The present disclosure relates to a method of drilling a well within a target stratum. The method can include: predicting a formation dip angle or a stratum depth for the target stratum using previously collected and/or historical data to form a proposed formation target window, choosing a point within the proposed formation target window to create a proposed target line, drilling based upon the proposed target line, collecting a first real time drilling data while drilling the proposed formation target window (done either at user defined stops, or during drilling), using the first real time drilling data in conjunction with the previously collected and/or historical data to calculate an instantaneous formation dip angle or an instantaneous stratum depth for the target stratum at a user defined drilling interval, using the instantaneous formation dip angle and the instantaneous stratum depth to form an instantaneous projected formation window, choosing a point within the instantaneous projected target window to create an instantaneous projected target line, wherein the instantaneous projected target line directs the wellbore toward a desired target, and correcting the steering of the drill bit based upon the instantaneous projected target line by adjusting direction of the bit, position of the bit, or drilling parameters. Then repeating the process while drilling at user defined intervals. This can happen while drilling or after stopping drilling for a user defined survey interval.

In embodiments, the method can also include collecting a second real time drilling data while and during drilling the instantaneous projected target line, using the second drilling data in conjunction with the previously collected and/or historical data to calculate an instantaneous formation dip angle and an instantaneous stratum depth for a second target stratum while drilling at a user defined drilling interval, using the instantaneous formation dip angle and the instantaneous stratum depth to form a second instantaneous projected target line, and correcting the steering of the drill bit based upon the second instantaneous projected target line.

For the purposes of this disclosure the methodology is the same whether starting and stopping the drilling process to form an instantaneous projected formation window (from which a point can be selected and a target line created), or performing the steps while drilling. For the next recursive execution of the method steps, the data collected from the previous step can be classified as previously collected data and a new target point or line established. Further, data collected during the current iteration of the method steps can then be reclassified as previously collected data for the next recursive step.

Instantaneous, as used within this disclosure, refers to an updated prediction or projection. It is not necessarily a reference to a chronology or time stamp but, instead relates specifically to the current drilling operation. An instantaneous projected formation window, therefore, can be a window projected while drilling, or at a user specified interval when drilling is halted to adjust or verify steering parameters.

Horizontal drilling of an oil well, often referred to as directional drilling often involves a significant amount of historical regional data guesswork prior to the commencement of drilling. During the drilling process, the educated "guess" or "guesses" that have been made with regard to the geology of the formation stratum being drilled must often be updated and corrected as new information becomes available during the drilling process.

Key information required by a user while drilling includes the formation depth and the formation dip angle for a formation being drilled. The formation dip angle refers to the inclination (or declination) measured from horizontal of the formation stratum that the user desires to drill as. Essentially, the formation dip angle defines a slope of the formation and a slope of the targeted formation in relation to a horizontal plane. As geological formations are not necessarily uniform or regular, the overall height of the formation stratum, the thickness or depth of the formation stratum, the dip angle of the formation stratum, and the depth of the formation and targeted formation stratum can vary as the user drills.

It is important to note here that the target stratum may or may not be the stratum being drilled. If an adjacent stratum is being utilized for the drill bit to follow "over" or "under" the target window, point, line, etc. can be offset from the path of the drill bit. In embodiments, the target window may be referencing a marker bed "over" or "under" the stratum being drilled and the drill bit aimed with an offset direction or displacement as needed to keep the drill bit at a desired relative position to the marker bed.

Often, a formation dip angle and/or a stratum depth is extrapolated using previously collected historical and regional data from nearby wells that have been drilled. Previously collected data can include (among other data) actual drilling data and survey data from operations that occurred in the past. An initial formation dip angle and/or stratum depth is often just a linear extrapolation of two or more data points.

For the purposes of the present disclosure, actual drilling data is defined as downhole and surface data that is obtained at a drill site while the drill bit is drilling formation to achieve greater depth and distance, circulating at user-defined intervals, or pulling the drill bit from the wellbore. Actual drilling data comprises sensor data actually collected at a drill site, including during actual drilling operations. Other data, such as simulated data, can be used in conjunction with actual drilling data as desired by persons having ordinary skill in the art.

Previously collected data comprises data collected prior to the current operation in question. It is important to note that this data comprises data that may have been collected prior to the portion of the target stratum being drilled, but may include real time data collected during drilling of previous portions of the target stratum.

Survey data, for the purposes of the present disclosure, comprises data collected at user defined intervals when active drilling was not taking place. Survey data may comprise surveys, offset logs, type logs, synthetic logs, existing well logs, seismic, maps, synthetically generated maps from offset drilling data, and the like as used in the industry to help predict a formation dip angle and a stratum depth for the formation and target stratum.

Previously collected data may comprise information such as weight on bit (WOB), pressure, torque, rpm, string weight, mud weight, gas, differential pressure, annulus pressure, flow rates, pump rates, backside pressure, mechanical specific energy, pore pressure, horizontal stress, vibration, tank volumes, returns, inclination angle, azimuth or direction of the drill bit, gamma, resistivity, density, sonic, azimuthal gamma, annulus pressure, instant inclination, seismic, directionally defined gamma, depth, investigation logging data, etc. We can also have near bit, gamma, resistivity, density, sonic, azimuthal gamma, annulus pressure, instant inclination, seismic, directionally defined gamma, offset subsurface data, seismic data, image log data, electric log data, synthetic log data, survey data, drilling data, and the like as used by directional drillers, or combinations thereof.

The above is a non-exhaustive exemplary list of typically used data to predict a formation dip angle and a stratum depth for a formation and target stratum, other data, including other data known in the industry and to those having ordinary skill in the art, may also be used and is within the scope of the present invention. The previously collected data is analyzed and manipulated to predict a formation dip angle and a stratum depth for the target stratum.

However, as the previously collected data is often for spatially removed drill sites, the predicted formation dip angle and stratum depth are extrapolated and "guessed" at to create a proposed formation target window for drilling a well. The proposed formation target window is a set of parameters with which to "aim" the drill bit when starting the drilling. The formation dip angle and stratum depth are used to determine what and where the proposed formation target window is.

The term "target window" is used within this disclosure to mean a direction and depth which a drill bit utilizes to be aimed in order to reach a specific spatial goal. The target window can be graphically represented as a line, shape, volume, cross section, point, map or seismic map, and the like, and projected ahead of the drill bit. Various mechanisms are known to persons having ordinary skill in the art to represent this concept. The target window is functionally designed to give the "driver" of the drill bit something to "aim" at. When the target window is defined as a volume or a cross section ahead of the drill bit, the user can select any target point within the target window to define a target line at which to aim the drill bit or wellbore. The target line can be drawn from any starting point to that target point, such as a user selected starting point, or the drill bit location. In embodiments, the target window may be referencing a marker bed "over" or "under" the stratum being drilled and the drill bit aimed with an offset direction or displacement as needed to keep the drill bit at a desired relative position to the marker bed.

Once a user commences drilling, aiming at the proposed formation target window (created from previously collected data), a first real time drilling data can be collected. The real time drilling data can include the same parameters as previously collected data, only this is collected as the drill bit is stopped at user defined intervals, or actually drilling toward the formation target window. As persons having ordinary skill in the art are aware, real time in the industry may be slightly delayed. For the purposes of the present disclosure, real time is used to refer to data for the current drilling operation.

A non-exhaustive list of data includes weight on bit (WOB), pressure, torque, rpm, string weight, mud weight, gas, differential pressure, annulus pressure, flow rates, pump rates, backside pressure, mechanical specific energy, pore pressure, horizontal stress, vibration, tank volumes, returns, inclination angle, azimuth or direction of the drill bit, gamma, resistivity, density, sonic, azimuthal gamma, annulus pressure, instant inclination, seismic, directionally defined gamma, etc. We can also have near bit, gamma, resistivity, density, sonic, azimuthal gamma, annulus pressure, instant inclination, seismic, directionally defined gamma, offset subsurface data, seismic data, image log data, electric log data, synthetic log data, survey data, drilling data, and the like as used by directional drillers, or combinations thereof.

The first real time drilling data can be used in conjunction with the previously collected data to form an instantaneous formation dip angle and an instantaneous stratum depth for the formation and target stratum. This can be done at user defined intervals while drilling has stopped or is still proceeding.

Persons having ordinary skill in the art will recognize that various parameters equivalent to the formation dip angle can be utilized. Various parameters such as a slope of the formation, sine, cosine, tangent, etc. of the formation dip angle can be used. It will be apparent, however that these parameters are merely a different form of the dip angle, and the present disclosure is intended to include such equivalents when the terms "formation dip angle", "instantaneous formation dip angle", "predicted formation dip angle" and the like are used. For the purposes of this disclosure, any industry accepted method of calculating dip, or any industry accepted equivalent of dip can be utilized.

The instantaneous formation dip angle and an instantaneous stratum depth can be used to form an instantaneous projected formation window (or line, cross section, map, synthetic log, etc.). The user can then drill ahead by aiming at the instantaneous projected formation window.

The present disclosure is novel in that the drilling process need not be stopped to adjust the projected formation window but can be stopped at user defined intervals. Instead, the formation window can be instantaneously adjusted while drilling. Presently in the art, drilling is stopped, and one or more surveys taken prior to adjusting a target for drilling. In fact, the target is typically not adjusted after each survey, but users prefer to accumulate a significant amount of data prior to changing a target window.

The method can also include collecting a second real time drilling data while drilling the instantaneous projected formation window. Note that at this point, the first real time drilling data becomes classified as previously collected data.

The second real time drilling data can be used in conjunction with the previously collected data to calculate yet another instantaneous formation dip angle and an instantaneous stratum depth for the instant in time that the second real time drilling data is collected. A new instantaneous projected formation window can be formed at this point in time.

In this manner, any number of subsequent real time drilling data collections can be made, at user defined intervals. Each subsequent real time drilling data can be used to calculate yet another instantaneous formation dip angle and an instantaneous stratum depth for the instant in time that each subsequent real time drilling data is collected. A new instantaneous projected formation window can be formed at each subsequent point in time, if desired.

The method can include automatically adjusting drill bit and/or drilling parameters using the results of the disclosed methods. A computer can communicate with a controller at the drill site to adjust drill bit steering based upon the most recent instantaneous projected formation window In embodiments, previously collected data can be updated, supplemented, and/or corrected with drilling data. As much data is extrapolated, as actual data and/or real time data becomes available, previously collected data can be updated. The present method can update the previously collected data in order to have more accurate instantaneous formation dip angle, instantaneous stratum depth, and instantaneous projected formation window calculations.

Turning now to the Figures, FIG. 1 is a schematic representation of a wellbore.

Shown here is drilling rig 96 with string 100. The string 100 makes a first directional change at 106 and a second directional change at 110. The proposed formation target window 98 can have a height 99 (or thickness, or depth). In this embodiment, 108*a* and 108*b* show the top and bottom of the proposed formation target window 98 respectively. At point 112, the logging while drilling device(s) 104 and the drill bit 102 are within the proposed formation target window 98, and real time data can be collected from the logging while drilling device(s) 104.

FIG. 2 is a schematic representation of a wellbore showing a change in stratum dip.

While the drill bit is within the proposed formation target window 98, and is following the target line 202*a* created by selecting point 200*a* within the proposed formation target window 98, the dip angle of the formation has changed, and while the target was proposed to have a top and bottom of 108*a* and 108*b* respectively, the stratum top and stratum bottom are shown here as 108*c* and 108*d* respectively.

FIG. 3 is a schematic representation of a wellbore showing a correction in steering the drill bit.

Here real time drilling data can be used in conjunction with the previously collected data to calculate an instantaneous formation dip angle and an instantaneous stratum depth for the target stratum and create an instantaneous projected formation window with a top and bottom 108*e* and 108*f* respectively.

Anew point 200*b* can be selected to form an instantaneous projected target line 202*b*, which directs the wellbore toward a desired target by correcting the steering of the drill bit.

While the present disclosure emphasizes the presented embodiments, it should be understood that within the scope of the appended claims, the invention might be practiced other than as specifically enabled herein. Modifications and improvements can be made to the inventive concepts herein without departing from the scope of the invention. The embodiments shown herein are merely illustrative of the inventive concepts and should not be interpreted as limiting the scope.

What is claimed is:

1. A method of drilling a well within a target stratum comprising:

predicting a formation dip angle or a stratum depth for the target stratum using previously collected data to form a proposed formation target window;

choosing a point within the proposed formation target window to create a proposed target line to direct the drill bit toward the point;

drilling based upon the proposed target line;

collecting a first real time drilling data while drilling the proposed target line;

using at least a portion of the first real time drilling data in conjunction with at least a portion of the previously collected data to calculate an instantaneous formation dip angle or an instantaneous stratum depth for the target stratum at a user defined drilling interval;

using the instantaneous formation dip angle or the instantaneous stratum depth to form an instantaneous projected formation window;

choosing an instantaneous point within the instantaneous projected target window to create an instantaneous projected target line, wherein the instantaneous projected target line directs the drill bit toward a desired target; and correcting the direction and position of the drill bit based upon the instantaneous projected target line or the instantaneous point.

2. The method of claim 1, further comprising:

collecting a second real time drilling data while drilling the instantaneous projected target line;

using at least a portion of the second real time drilling data in conjunction with at least a portion of the previously collected data to calculate an instantaneous formation dip angle and an instantaneous stratum depth for a second target stratum at a user defined drilling interval;

using the instantaneous formation dip angle and the instantaneous stratum depth to form a second instantaneous projected target line; and steering the drill bit based upon the second instantaneous projected target line.

3. The method of claim 1, wherein the previously collected data comprises offset subsurface data, seismic data, image log data, electric log data, synthetic log data, survey data, drilling data, or combinations thereof.

4. The method of claim 1, further comprising stopping drilling at user defined intervals.

5. The method of claim 1, further comprising automatically adjusting direction, position, or drilling parameters at a drill site.

6. The method of claim 1, wherein the previously collected data is updated, corrected, or updated and corrected with drilling data.

7. The method of claim 1, wherein the previously collected data is updated and/or corrected with real time drilling data.

8. The method of claim 1, wherein the previously collected data is supplemented with at least one of drilling data, simulation data, and survey data.

9. The method of claim 2, further comprising repeating the steps of collecting real time drilling data and using the real time drilling data to calculate an instantaneous formation dip angle and an instantaneous stratum depth for subsequent target strata at user defined intervals, using the instantaneous formation dip angle and the instantaneous stratum depth to form subsequent instantaneous projected target lines, and drilling ahead based upon each subsequent instantaneous projected target line.

10. The method of claim 5, wherein a computer processor communicates with an operator on site to adjust drill bit steering, or with a controller to automatically adjust direction, position, or drilling parameters.

11. A method of drilling a well within a target stratum comprising:

predicting a formation dip angle and a stratum depth for the target stratum using previously collected data to form a proposed formation target window;

choosing a point within the proposed formation target window to create a proposed target line to direct the bit toward the point;

drilling based upon the proposed target line;

collecting a first real time drilling data while drilling the target line;

using the first real time drilling data in conjunction with the previously collected data to calculate an instantaneous formation dip angle and an instantaneous stratum depth for the target stratum at a user defined drilling interval;

using the instantaneous formation dip angle and the instantaneous stratum depth to form an instantaneous projected formation window;

choosing an instantaneous point within the instantaneous projected target window to create an instantaneous projected target line, wherein the instantaneous projected target line directs the wellbore toward a desired target; and correcting the direction and position of the drill bit based upon the instantaneous projected target line or the instantaneous point.

12. The method of claim 11, further comprising:

collecting a second real time drilling data while drilling the instantaneous projected target line;

using at least a portion of the second real time drilling data in conjunction with the previously collected data to calculate at least one of an instantaneous formation dip angle and an instantaneous stratum depth for a second target stratum at a user defined drilling interval;

using at least one of the instantaneous formation dip angle and the instantaneous stratum depth to form a second instantaneous projected target line; and correcting the steering of the drill bit based upon the second instantaneous projected target line.

* * * * *